US006326727B1

(12) United States Patent
Chung

(10) Patent No.: US 6,326,727 B1
(45) Date of Patent: Dec. 4, 2001

(54) PLASMA DISPLAY PANEL WITH DIELECTRIC LAYER AND PROTECTIVE LAYER IN SEPARATED SHAPE AND METHOD OF FABRICATING THE SAME

(75) Inventor: Jae Sang Chung, Kyunggi-do (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/316,142

(22) Filed: May 21, 1999

(30) Foreign Application Priority Data

Jul. 4, 1998 (KR) ..... 98-27027

(51) Int. Cl.[7] ..... H01J 17/49

(52) U.S. Cl. ..... 313/586; 313/587; 313/585; 345/60

(58) Field of Search ..... 313/587, 586, 313/585, 584, 582, 581; 345/41, 60

(56) References Cited

U.S. PATENT DOCUMENTS 5,548,186 * 8/1996 Ota ..... 313/586 X
5,703,437 * 12/1997 Komaki ..... 313/587 X
5,736,815 * 4/1998 Amemiya ..... 313/582 X
5,977,708 * 11/1999 Amatsu et al. ..... 313/587 X

FOREIGN PATENT DOCUMENTS 1998-077352 11/1998 (KR) .

* cited by examiner

*Primary Examiner*—Ashok Patel
(74) *Attorney, Agent, or Firm*—Fleshner & Kim, LLP

(57) ABSTRACT

A plasma display panel with separate dielectric layer and protective layer and a method of fabricating the same that is suitable for improving the brightness. In the plasma display panel, a sustaining electrode pair is formed on a substrate, and a dielectric layer and a protective layer are disposed on each of the sustaining electrode pair. Also, a gap is provided between the dielectric layer and the protective layer. Accordingly, a lot of electrons and ions having a high energy at the time of discharge are generated and a discharge cell space is enlarged.

5 Claims, 4 Drawing Sheets

PLASMA DISPLAY PANEL WITH DIELECTRIC LAYER AND PROTECTIVE LAYER IN SEPARATED SHAPE AND METHOD OF FABRICATING THE SAME

BACKGROUND OF THE INVENTION

1. Field of the Invention

This invention relates to a plasma display panel, and more particularly to a plasma display panel capable of improving its brightness and a method of fabricating the same.

2. Description of the Related Art

Generally, a plasma display panel(PDP) radiates a fluorescent material by an ultraviolet with a wavelength of 147 nm generated during a discharge of He+Xe or Ne+Xe gas to thereby display a picture including characters and graphics. Such a PDP permits it to be easily made into a thin film and large-dimension type. Moreover, the PDP provides a very improved picture quality owing to a recent technical development. The PDP is largely classified into a direct current (DC) driving system and an alternating current(AC) driving system.

The PDP of AC driving system is expected to be highlighted into a future display device because it has advantages in the low voltage drive and a prolonged life in comparison to the PDP of DC driving system. Also, the PDP of alternating current driving system allows an alternating voltage signal to be applied between electrodes, which dielectric layers are intervened between, to generate a discharge every half-period of the signal, thereby displaying a picture. Since such an AC type PDP adapts a dielectric material which surface accumulate a wall charge during the discharge, a memory effect is produced.

Referring to FIG. 1, there is shown a PDP of AC driving system that includes an upper plate 20 and a lower plate 22. The upper plate 20 consists of a sustaining electrode pair 6 arranged, in parallel, on an upper glass substrate 2, a bus electrode pair 10 installed in each of the sustaining electrode pair 6, a dielectric layer 14 formed on the surfaces of the bus electrode pair 10 and the upper glass substrate 2, and a protective layer 16 formed on the dielectric layer 14. The sustain electrode pair 6 is made from a transparent metal material (e.g., indium tin oxide), and which allows a surface discharge to be maintained successively during a sustaining period. Generally, the sustaining electrode pair 6 is formed on the upper glass substrate 2 by the screen printing technique. The bus electrode pair 10 is responsible for reducing an electrical resistance of the sustaining electrode pair 6. The bus electrode pair 10 is formed on each of the sustaining electrode pairs 6 by vapor-depositing Cr/Cu/Cr and thereafter etching the same. The dielectric layer 14 is accumulated with electric charges generated during the discharge. The dielectric layer 14 is formed on the sustaining electrode pair 6 and the upper glass substrate 2 by the screen printing technique. The protective layer 16 is responsible for protecting the dielectric layer 14 from a sputtering due to the discharge. The protective layer 16 is grown on the dielectric layer 14 with MgO with a thickness of about 2000 Å. FIG. 2 shows a plane arrangement state of the upper plate 22.

The lower plate 22 includes address electrodes 8 provided on a lower glass substrate 4 in such a manner to be perpendicularly crossed with the sustaining electrode pair 6, a barrier rib 12 extended perpendicularly from the surface of the lower glass substrate 4 with positioning the address electrodes 8 therebetween, and fluorescent bodies 18R, 18G and 18B coated on the barrier rib 12 and the lower glass substrate 4. The address electrode 8 allows an opposite discharge to be generated along with one sustaining electrode in the sustaining electrode pair 6 during an address period to thereby select discharge cells being displayed. The address electrode 8 is formed on the lower glass substrate 4 by the screen printing technique. The barrier rib 12 provides a discharge space of the discharge cell along with the upper and lower glass substrates 2 and 4 to shut out an electrical and optical interference between the discharge cells. The barrier rib 12 is formed in such a manner to be perpendicularly extended from the lower glass substrate 4 by the screen printing technique or the sand blast technique. The fluorescent bodies 18R, 18G and 18B is excited by an ultraviolet generated during the discharge and then transited, thereby generating an intrinsic color of visible light.

After bonding the upper plate 20 to the lower plate 22 and evacuating a residual air within a discharge space in the discharge cell between the upper plate 20 and the lower plate 22, an discharging gas such as He+Xe or Ne+Xe is injected into the discharge space in the discharge cell with an appropriate pressure through the injection hole. Then, the injection hole is sealed such that the discharge cell has an airtight structure, thereby completing a PDP of AC driving system.

The radiation in the PDP of AC driving system allows an opposite discharge to be generated at a part of discharge cells in the address interval, and allows each discharge cell generating the opposite discharge to perform a surface discharge in the sustaining interval, thereby displaying a picture. More specifically, if a voltage is applied to a single sustaining electrode of the sustaining electrode pair 6 and to the address electrode 8, then the opposite discharge is generated between the sustaining electrode 6 and the address electrode 8 by a voltage difference. An ultraviolet generated by the address discharge excites and transits the fluorescent bodies 18R, 18G and 18B. At this time, the fluorescent bodies 18R, 18G and 18B generates a visible light. The sustaining electrode pair 6 generates a surface discharge by a sustaining pulse applied in the sustaining interval to maintain the radiation of the fluorescent bodies 18R, 18G and 18B.

As shown in FIG. 3, a discharge generated in the course of the sustaining interval is enlarged from the nearest part to the sustaining electrode pair 6(i.e., a part in which the discharge radius R is minimum) into the distant part thereto (i.e., a part in which the discharge radius R is large) as a sustaining discharge time elapses. At this time, an intensity of electric field becomes largest at the part having a minimum discharge radius R. Accordingly, the density of electron and ion is highest at the surface of the protective layer 16 in which electrons and ions with a high temperature and energy exist mostly. Since a quantity of ultraviolet applied to the fluorescent bodies 18R, 18G Dan 18B becomes larger as the density of electron and ion becomes higher, the brightness increases. On the contrary, since a quantity of ultraviolet becomes smaller as the density of electron and ion becomes lower, the brightness decreases.

In the conventional AC driving system PDP, the brightness is raised by heightening a level of the sustaining pulse to heighten the density of electrons and ions generated during the discharge. However, it is difficult to obtain a brightness at the satisfiable level even when the sustaining voltage is raised. Also, a consumption power of the PDP is increased as the sustaining voltage becomes high. Accordingly, a scheme capable of obtaining a sufficient brightness is required for the AC driving system PDP.

SUMMARY OF THE INVENTION

Accordingly, it is an object of the present invention to provide a plasma display panel with separate dielectric layer and protective layer that is suitable for obtaining a sufficient brightness.

Further object of the present invention is to provide a plasma display panel with separate dielectric layer and protective layer that is capable of lowering a driving voltage.

In order to achieve these and other objects of the invention, a plasma display panel with separate dielectric layer and protective layer according to one aspect of the present invention includes dielectric layers and protective layers disposed on each sustaining electrode pair; and a gap defined between the dielectric layers and the protective layers.

A plasma display panel with separate dielectric layer and protective layer according to another aspect of the present invention includes first and second sustaining electrodes formed on a glass substrate; first and second dielectric layers grown separately on each of the first and second sustaining electrodes; and first and second protective layers grown on each of the first and second dielectric layers.

A method of fabricating a plasma display panel with separate dielectric layer and protective layer according to still another aspect of the present invention includes the steps of forming a sustaining electrode pair on a glass substrate; disposing dielectric layers and protective layers on each of the sustaining electrode pair; and providing a gap between the dielectric layers and the protective layers.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Figure 4:
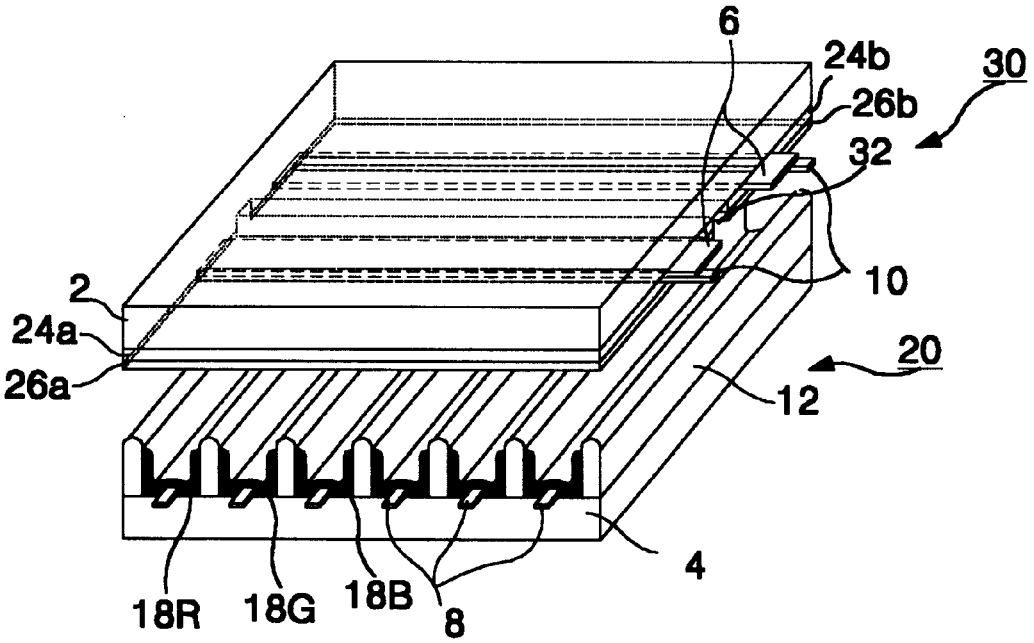
FIG. 4 is a perspective view showing the structure of a plasma display panel with separate dielectric layer and protective layer according to an embodiment of the present invention.
Figure 5:
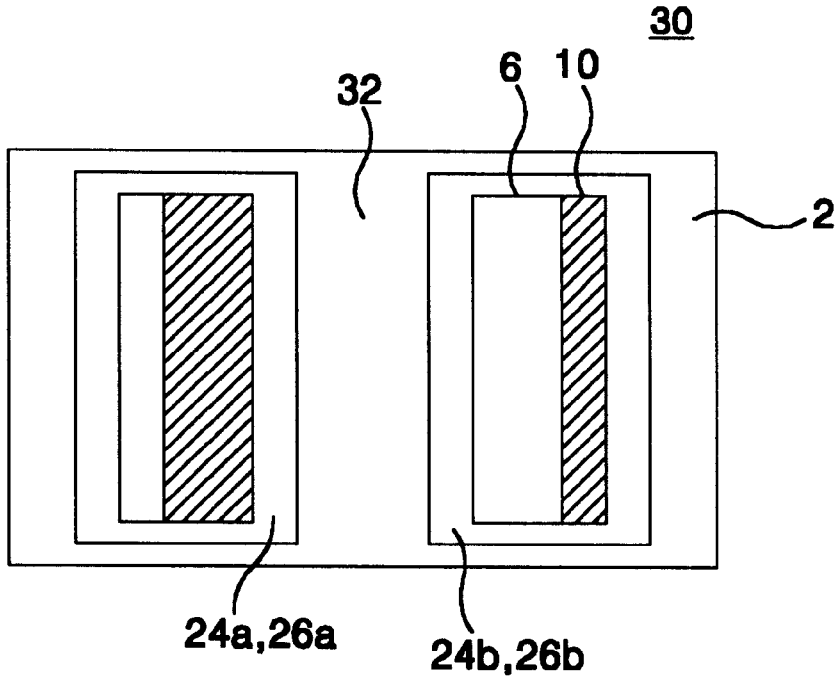
FIG. 5 is a plan view of the upper plate shown in FIG. 4.

Referring to FIG. 4 and FIG. 5, there is shown a plasma display panel with separate dielectric layer and protective layer according to the present invention. The plasma display panel is classified into an upper plate 30 and a lower plate 20.

The upper plate 30 includes a sustaining electrode pair 6 formed at an upper glass substrate 2, a bus electrode pair 10 formed, in parallel, on the sustaining electrode pair 6, dielectric layers 24*a* and 24*b* grown in a separate type at each of the sustaining electrode pair 6 and the bus electrode pair 10, and protective layers 26*a* and 26*b* formed on each dielectric layers 24*a* and 24*b*. The sustaining electrode pair 6 allows an opposite discharge to be generated in an address interval along with an address electrode. Also, the sustaining electrode pair 6 allows a surface discharge to be generated in a sustaining interval. The bus electrode pair 10 is responsible for reducing an electrical resistance of the sustaining electrode pair 6. An electric charge is accumulated in the dielectric layers 24*a* and 24*b* during the discharge. The protective layers 26*a* and 26*b* are responsible for protecting the dielectric layers 24*a* and 24*b* from a sputtering due to the discharge. A desired width of gap 32 is provided at the center of the dielectric layers 24*a* and 24*b* and the protective layers 26*a* and 26*b*, that is, between the sustaining electrode pairs 6.

Figure 1:
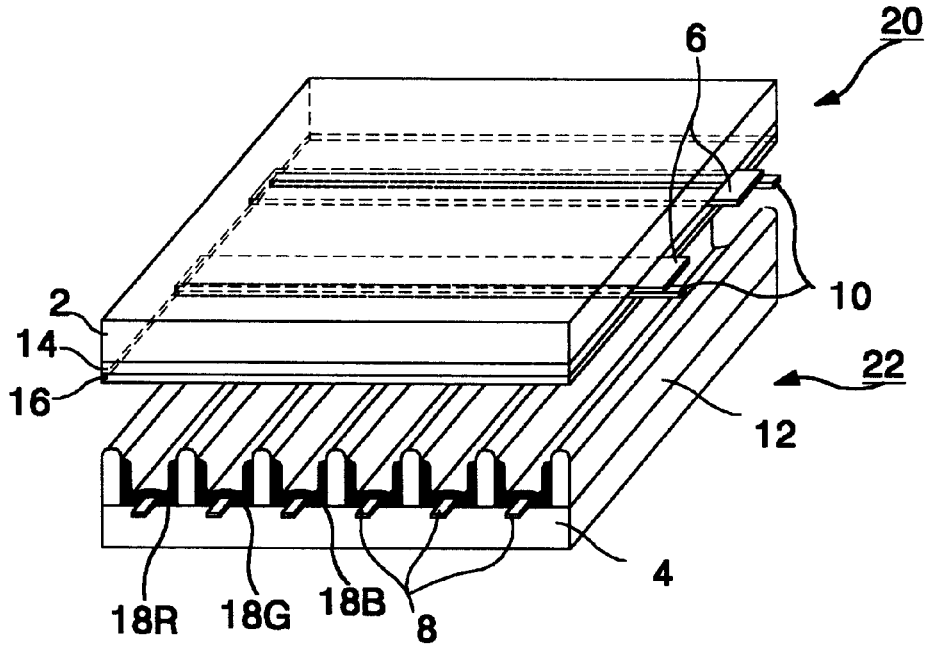
FIG.1 RELATED ART
FIG. 1 is a schematic perspective view showing the structure of a conventional plasma display panel.
Figure 2:
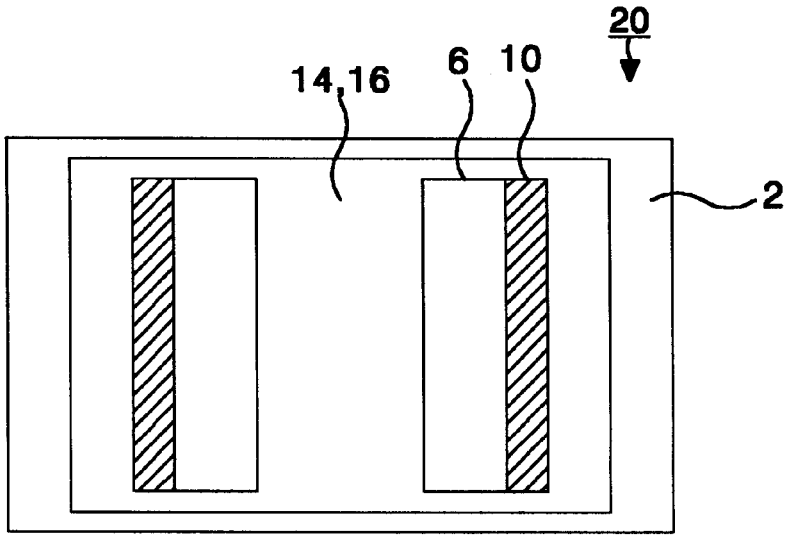
FIG.2 RELATED ART
FIG. 2 is a plan view of the upper plate shown in FIG. 1.
Figure 3:
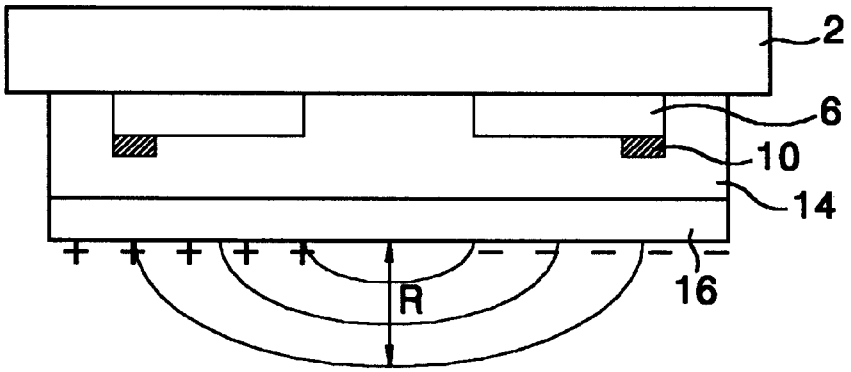
FIG.3 RELATED ART
FIG. 3 is a longitudinal sectional view of the upper plate for representing a discharge path in FIG. 1.

A lower plate 20 is substantially identical to that in FIG. 1, so that the same reference numerals are used and the detailed description is omitted.

A plasma display panel according to the present invention displays a picture by generating the face discharge after the opposite discharge. When a voltage is applied to any one electrode of the sustaining electrode pair 6 and to the address electrode 8, an opposite discharge is generated therebetween. An ultraviolet generating at this time allows the fluorescent bodies 18R, 18G and 18B to be excited and transited, thereby generating a visible ray. After the opposite discharge, the sustaining electrode pair 6 responds to a sustaining pulse to generate a sustaining discharge, thereby maintaining a radiation at the time of the opposite discharge.

Figure 6:
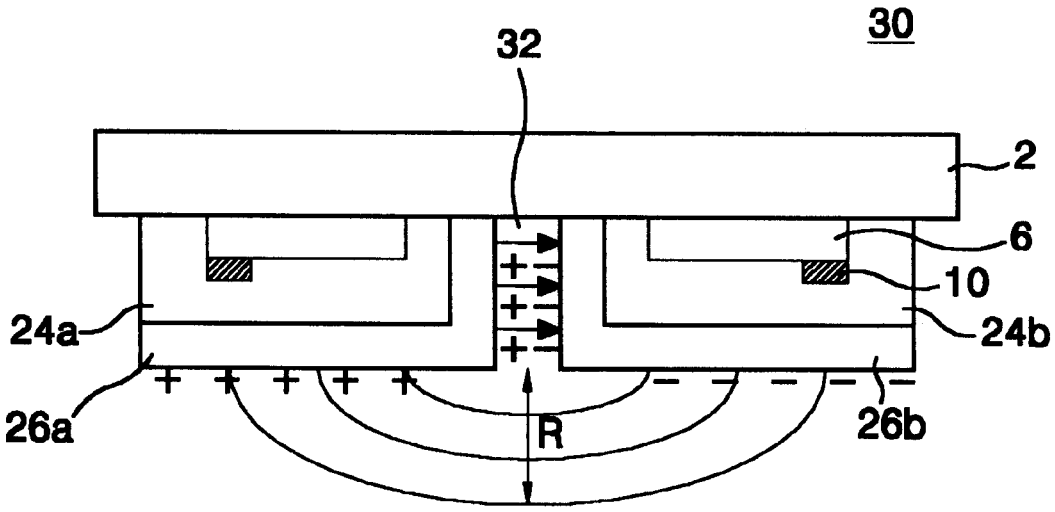
FIG. 6 is a longitudinal sectional view of the upper plate for representing a discharge path in FIG. 4.

As shown in FIG. 6, a discharge path at the time of the sustaining discharge is extended from a part nearest to the sustaining electrode pair 6(i.e., a part in which a discharge radius R becomes a minimum value) into a part distant therefrom(i.e., a part in which a discharge radius R is large) as a sustaining discharge time elapses. At this time, a gap 32 turns into a discharge space at which a high electric field is concentrated. This gap 32 has the highest electron and ion densities within the discharge cell space. Since most of electrons and ions having high temperature and energy concentrates at the gap 32, an ionizing phenomenon and an exciting phenomenon are generated concentratively at the gap 32. Accordingly, an intensity of an ultraviolet(UV) generating at the gap 32 becomes strongest. The fluorescent bodies 18R, 18G and 18B are excited and transited by the ultraviolet generated from the gap 32 and an ultraviolet generated from the remaining discharge space. As a result, red, green and blue visible lights is generated from the fluorescent bodies 18R, 18G and 18B.

Figure 7:
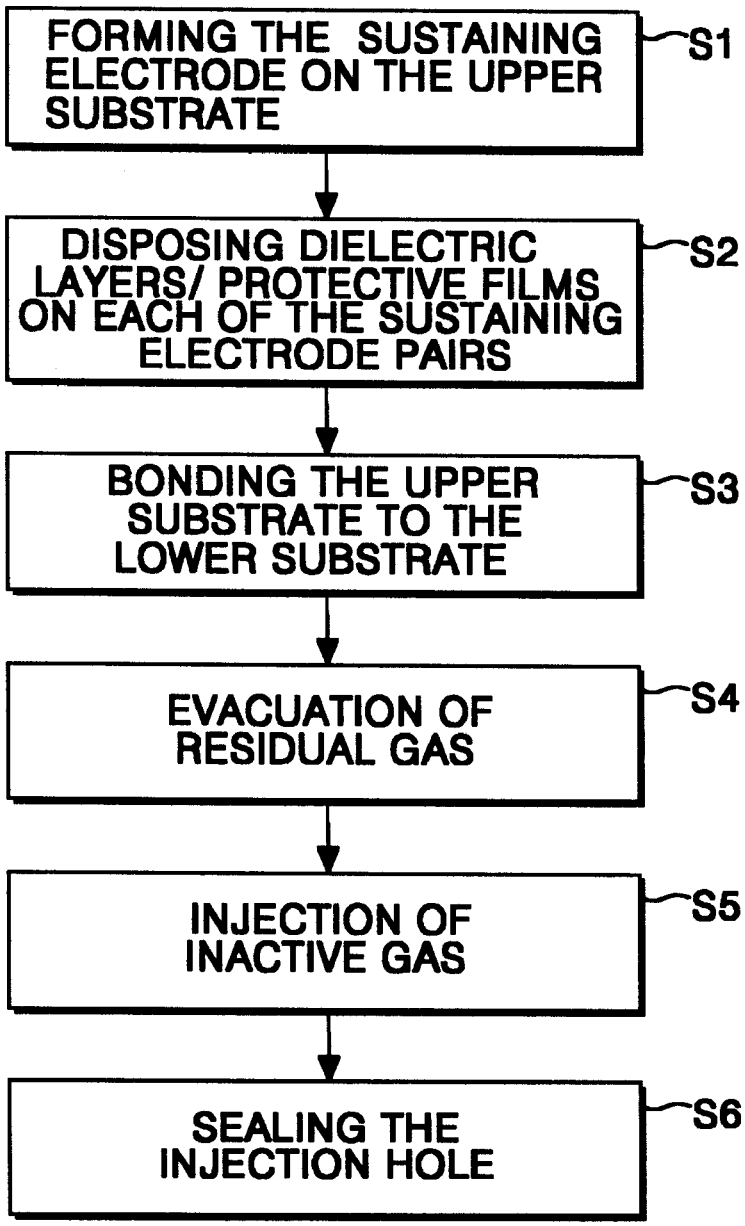
FIG. 7 is a flow chart showing a method of fabricating a plasma display panel with separate dielectric layer and protective layer according to the present invention.

A method of fabricating a plasma display panel according to the present invention will be described with reference to FIG. 7 step by step.

First, in step S1, the sustaining electrode pair 6 made from a transparent metal material(e.g., indium tin oxide) having a high light transmissivity) is formed on the upper glass substrate 2, and the bus electrode pair 10 consisting of Cr/Cu/Cr is formed on the sustaining electrode pair 6 in the longitudinal direction thereof. In step S2, the dielectric layers 24*a* and 24*b* and the protective layers 26*a* and 26*b* are disposed on the sustaining electrode pair 6 and the bus electrode pair 10. At this time, the gap 32 is provided at the center of the dielectric layers 24*a* and 24*b* and the and the protective layers 26*a* and 26*b*.

Each of the protective layers is grown into a thickness of about 2000 Å in such a manner to surround the side surfaces of the dielectric layers 24*a* and 24*b*. A width of the gap 32 is preferably less than about 50 $\mu$m because a space between the sustain electrode pairs is designed into approximately 100 $\mu$m. As for a process of fabricating the dielectric layers 24*a* and 24*b* and the protective layers 26*a* and 26*b*, a mask pattern is defined at the part provided with the gap 32, and the dielectric layers 24*a* and 24*b* are grown on the upper portions of the sustaining electrode pair 6 and the bus electrode pair 10 in such a manner to be separated by the mask pattern. The protective layers 26*a* and 26*b* are grown on the respective protective layers 26*a* and 26*b*. Alternatively, after a dielectric layer was grown on the whole surface of the upper glass substrate 2 having the sustaining electrode pair 6 and the bus electrode pair 10, separated dielectric layers 24*a* and 24*b* are formed by etching the center of the dielectric layer. The protective layers 26*a* and 26*b* are grown on the separated dielectric layers 24*a* and 24*b*. In step S3, the upper plate 30 with the configuration as described above is bonded to the lower plate 20 with making the barrier rib 12 therebetween. In step S4, a residual air existing in the discharge cell space provided between the upper plate 30 and the lower plate 20 is evacuated. In step S5, after a residual air was completely evacuated from the discharge space in the discharge cell between the upper plate 30 and the lower plate 20, an inactive gas (e.g., He+Xe or Ne+Xe) is injected into the discharge space in the discharge cell at an appropriate pressure. Finally, in step S6, the injection hole is sealed to thereby complete a plasma display panel provided with separate dielectric layers and protective layers according to the present invention.

As described above, in a plasma display panel with the separate dielectric layers and protective layers according to the present invention and a method of fabricating the same, the gap is defined between the dielectric layer and the protective layer disposed on each sustaining electrode, thereby generating a lot of electrons and ions having a high energy at the time of the discharge as well as enlarging the discharge cell space. Accordingly, since a visible light generated from the fluorescent material grows bright, the brightness thereof becomes high. Moreover, since a lot of electrons and ions with a high energy is generated and the discharge cell space are enlarged, a satisfiable brightness can be obtained by a low driving voltage, thereby reducing a consumption power as well as improving a discharge efficiency.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A plasma display panel with separate dielectric layer and protective layer, comprising:

dielectric layers and protective layers disposed on each sustaining electrode pair; and a gap defined by the dielectric layers and the protective layers between the sustaining electrode pair.

2. The plasma display panel as claimed in claim 1, wherein a width of the gap is less than 150 $\mu$m.

3. The plasma display panel as claimed in claim 1, wherein the sustaining electrode pair comprises:

a transparent electrode pair having a high light transmissivity; and a metal bus electrode for reducing a resistance coefficient of the transparent electrode pair.

4. A plasma display panel with separate dielectric layer and protective layer, comprising:

first and second sustaining electrodes formed on a glass substrate;

first and second dielectric layers grown separately on each of the first and second sustaining electrodes; and first and second protective layers grown on each of the first and second dielectric layers.

5. The plasma display panel as claimed in claim 4, further comprising:

a lower substrate provided with an address electrode for selecting a scanning line;

a barrier rib formed at the lower substrate to provide a discharge space; and a fluorescent material coated on the barrier rib and the lower substrate to generate a visible ray.

* * * * *